United States Patent [19]

Nagasaka et al.

[11] Patent Number: 4,796,583

[45] Date of Patent: Jan. 10, 1989

[54] ANTI-OVERRUNNING DEVICE FOR AN INTERNAL COMBUSTION ENGINE

[75] Inventors: Kohji Nagasaka, Kawasaki; Takeshi Kobayashi, Yokohama; Yoshimi Sejimo, Urayasu, all of Japan

[73] Assignee: Walbro Far East, Inc., Kawasaki, Japan

[21] Appl. No.: 102,354

[22] Filed: Sep. 29, 1987

[30] Foreign Application Priority Data

May 6, 1987 [JP] Japan ..... 62-110117

[51] Int. Cl.[4] ..... F02D 9/02

[52] U.S. Cl. ..... 123/378; 123/198 D; 123/376

[58] Field of Search ..... 123/332, 333, 351, 360, 123/376, 378, 392, 198 D

[56] References Cited

FOREIGN PATENT DOCUMENTS

| | | | |
|---|---|---|---|
| 172439 | 10/1983 | Japan | 123/351 |
| 46344 | 3/1984 | Japan | 123/378 |
| 228736 | 11/1985 | Japan | 123/376 |
| 261940 | 12/1985 | Japan | 123/378 |
| 1835 | 1/1986 | Japan | 123/378 |

*Primary Examiner*—Tony M. Argenbright

*Attorney, Agent, or Firm*—Barnes, Kisselle, Raisch, Choate, Whittemore & Hulbert

[57] ABSTRACT

An anti-overrunning device for an internal combustion engine utilizing a carburetor with a throttle valve and a vibrating pump for generating pressure by vibrations of the engine. An actuator is provided for the throttle valve to move it to a closing position, and a control valve is used to control flow of pressure from the vibrating pump to the actuator. A generator driven by the engine provides electromotive force to actuate the control valve.

1 Claim, 6 Drawing Sheets

ANTI-OVERRUNNING DEVICE FOR AN INTERNAL COMBUSTION ENGINE

REFERENCE TO RELATED APPLICATIONS

Reference is made to the following United States applications which are assigned to an assignee common to the present application:

Ser. No. 102,113—Filed Sept. 29, 1987
Ser. No. 102,133—Filed Sept. 29, 1987
Ser. No. 102,134—Filed Sept. 29, 1987
Ser. No. 102,383—Filed Sept. 29, 1987

FIELD OF INVENTION

The present invention relates to a device for inhibiting overrunning of an internal combustion engine utilizing engine vibrations.

OBJECTS AND FEATURES OF THE INVENTION

Portable working machines generally use a two-stroke engine as a power source. Particularly, a diaphragm type carburetor is employed to thereby make it possible to operate a machine in all attitudes. Accordingly, the two-stroke engine is often used for a chain saw, a brush cutter, etc. Generally such a portable working machine is operated with a light-weight, small-size and high-output internal combustion engine in order to enhance the working properties. However, in the chain saw or the brush cutter, when a throttle valve of a carburetor is totally opened under circumstances of a light or no torque load, the engine starts overrunning wherein the R.P.M. becomes excessive and may cause damage to the engine before a load is applied. The overrunning operation can likewise occur after the cutting work has been completed and the torque load is removed.

The overrunning may be avoided if the throttle valve is restored to a low setting every time there is an interruption of the work. However, because the intermittent work is repeatedly carried out, the operator often fails to cut back the throttle, thus resulting in damage to and shortening of the life of the engine.

In the past, this overrunning has been controlled by supplying an overrich fuel mixture to the engine when a throttle valve is fully opened or nearly fully opened under conditions of no or low torque load. However, this system increases the fuel consumption. Also, the ignition plug can become easily fogged, and exhaust fumes increase. Tar or the like tends to accumulate in the muffler.

The present inventors have proposed an antioverrunning device as disclosed in Japanese Patent Application Laid-Open No. 1835/1986. In this device, a vibrating pump is normally driven to directly supply pressure air to an actuator, but the diaphragm of the vibrating pump is always unsteady due to the vibrations of the engine and, as a result, the operating stability is poor. Also, it is difficult to set an actuating point at which a throttle valve is closed by an actuator during overrunning of the engine.

In view of the above-described difficulty, there has been proposed an arrangement wherein a control valve, which is opened by vibrations of the engine when the latter is overrun, is provided between a vibrating pump and an actuator. Even with this arrangement the relationship between the number of revolutions of the engine and the strength of the vibration varies at the beginning of and end of the use of the engine, and such a relationship varies also due to the temperature of the engine or the like. Furthermore, there is an unevenness in the relationship between the number of revolutions of the engine and the strength of the vibration depending on individual engines.

It is therefore an object of the invention to solve the aforementioned problem by providing an anti-overrunning device for an internal combustion engine in which an actuation point of the control valve is accurate, and thus the actuator is actuated by pressure air from the vibrating pump at the predetermined number of revolutions or more of the engine, and the throttle valve is automatically rotated in the closing direction.

In order to achieve the above-described object, the present invention provides an arrangement which comprises a vibrating pump for generating pneumatic pressure by vibrations of the engine; an actuator for actuating a throttle valve of a carburetor in a direction of closing the valve; and a control valve for controlling a flow of the pneumatic pressure from said vibrating pump to actuator during overrunning of the engine; the control valve is actuated by virtue of the electromotive force of a generator driven by the engine.

BRIEF DESCRIPTION OF THE OPERATION

Figure 1:
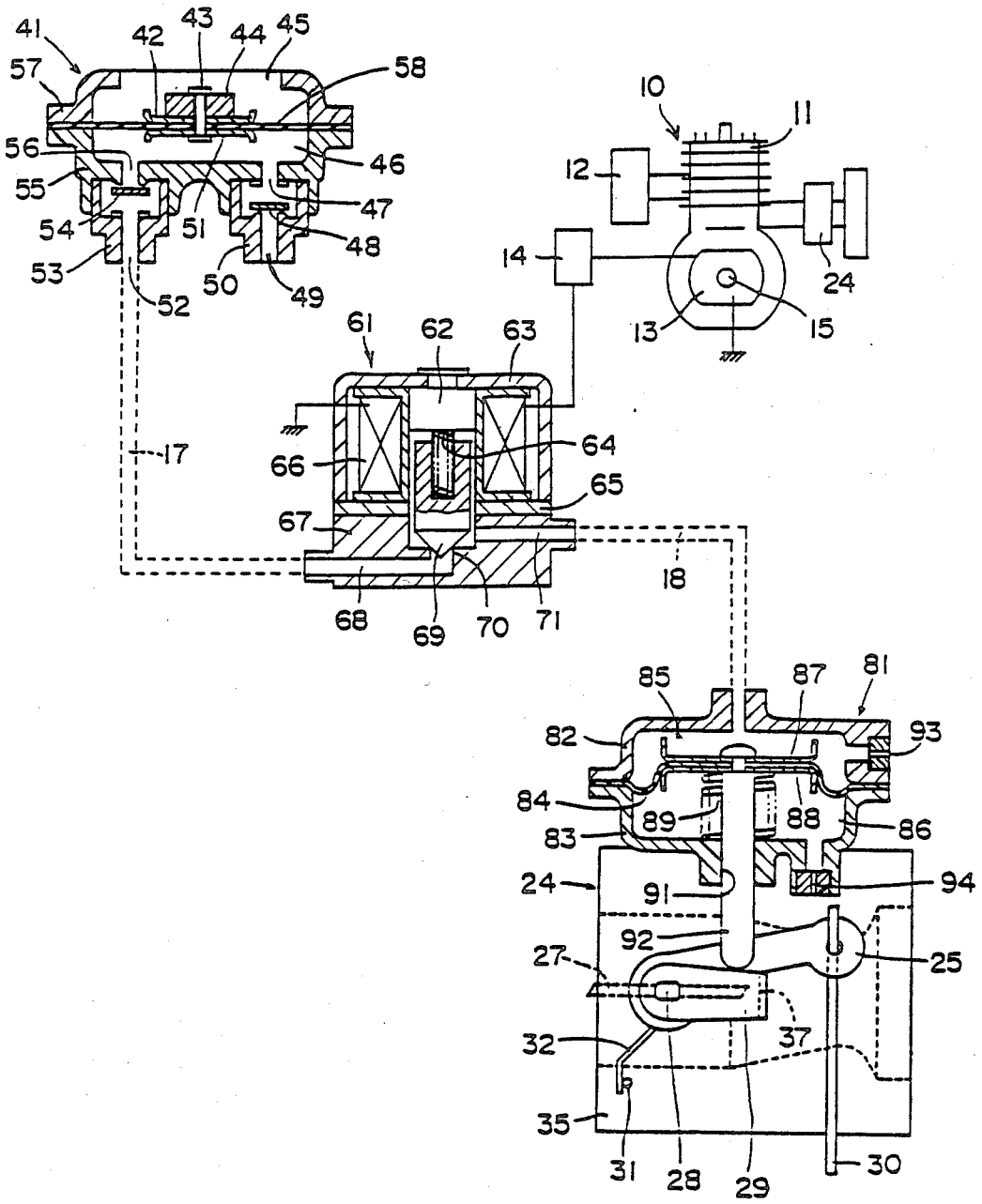
FIG. 1 is a side view showing the schematic structure of an anti-overrunning device for an internal combustion engine according to the present invention.

When the vibrating pump 41 mounted on an engine is subjected to vibrations of the engine, the weight 44 as well as a diaphragm 58 supporting the weight 44 reciprocate, and positive or negative pressure air is supplied toward the actuator 81.

However, in the normal running condition of the engine, since the actuation of the vibrating pump 41 or actuator 81 is cancelled by the control valve 61, the rod 92 of the actuator 81 for controlling a throttle valve lever is retracted by the force of the spring 89.

When the engine starts to overrun, an electromotive force or voltage of a generator 13 driven by the engine 10 becomes higher than a predetermined value. At that time, an electromagnetic force of an electromagnetic coil 66 of the control valve 61 is greater than the force of a spring 64, and the valve body 69, integral with the plunger, is moved away from the valve seat 70 to allow the functioning of the vibrating pump 41 and the actuator 81.

Positive or negative air is supplied from the vibrating pump 41 to a pressure chamber 85 of the actuator 81, and the rod 92 is projected. A throttle valve lever 29 as well as a valve shaft 28 are rotated by the rod 92 to shift the throttle valve 27 to a lower throttle position. In this manner, the quantity of the fuel and air mixture supplied to the engine is reduced, as a consequence of which the number of revolutions of the engine is lowered and the overrunning is automatically prevented.

DETAILED DESCRIPTION OF THE INVENTION

As shown in FIG. 1, in the internal combustion engine 10, a carburetor 24 and a muffler 12 are connected to one and the other, respectively, of a cylinder body 11 having cooling fins.

On the side of the crank case of the cylinder body 11 is provided a generator 13 driven by the crank shaft 15, and the electromotive force of the generator is utilized to intermittently apply a high voltage to the ignition plug so as to produce an electric spark.

Figure 2:
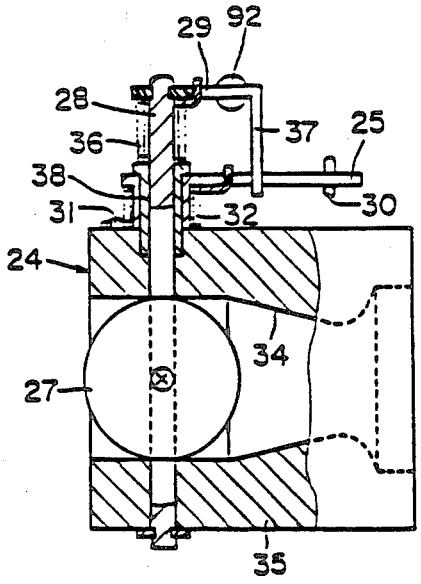
FIG. 2 is a horizontal sectional view of a carburetor to be provided with the anti-overrunning device.

As shown in FIG. 2, a throttle valve 27 is supported by the valve shaft 28 on a venturi 34 formed on the body 35 of carburetor 24, and fuel is supplied to the venturi 34 by negative pressure of air passing through the venturi 34. Such a fuel supply mechanism is known, for example, in U.S. Pat. No. 3,783,623 and directly has nothing to do with the gist of the present invention, and will not be further described.

An upper end of the valve shaft 28 is rotatably supported on the body 35 by means of a bearing sleeve 38, and an inverted L-shaped throttle valve lever 29 is secured to the upper end. One end of a spring 36 wound around the valve shaft 28 is placed in engagement with the throttle valve lever 29 and the other end thereof placed in engagement with the bearing sleeve 38. Also, a boss portion of the lever 25 is slipped over the bearing sleeve 38, and one end of a spring 32 wound around the boss portion is placed in engagement with the lever 25 whereas the other end is placed in engagement with a pin 31 of the body 35. An engaging portion 37 of the throttle valve lever 29 is projected downwardly so that it may engage with the edge of the lever 25.

In FIG. 1, the throttle valve lever 29 is pivotally urged counterclockwise by the force of the spring 36 to cause the engaging portion 37 to abut against the lever 25. The lever 25 is pivotally urged clockwise by the strong force of the spring 32 to close the throttle valve 27. When the lever 25 is rotated counterclockwise against the force of the spring 32 by a trigger wire 30, the throttle valve lever 29 also follows the lever 25 to increase an opening degree of the throttle valve 27.

The anti-overrunning device for the internal combustion engine according to the present invention is composed of a vibrating pump 41, a control valve 61 and an actuator 81 for reducing the throttle controlled opening by moving the throttle valve 27 through the throttle valve lever 29.

The vibrating pump 41 has a diaphragm 58 sandwiched between cup-like housings 57 and 55 to form an atmospheric chamber 45 and a pressure chamber 46. Pad plates 42 and 51 are placed on both surfaces of a diaphragm 58, and a weight 44 is connected by means of a rivet 43. The pressure chamber 46 is provided with passages 56 and 47, to which port members 53 and 50, respectively, are connected. The port member 53 is provided with a check valve 54 to allow a flow of air from the passage 56 to a passage 52. The port member 50 is provided with a check valve 48 to allow a flow of air from an atmospheric opening 49 to the passage 47. The passage 52 is connected to a passage 68 of the control valve 61 by a pipe 17.

The control valve 61 is in the form of a normally closed type electromagnetic valve. Passages 68 and 71 are provided in the housing 67 and a valve body 69 is urged by the force of the spring 64 against the valve seat 70 formed between the passages. The valve body 69 is integral with the plunger, and when the electromagnetic coil 66 is excited, the plunger and the valve body 69 are attracted against the force of the spring 64 and moved away from the valve seat 70. A bobbin of the coil 66 is accommodated in a cup-shaped core 63 and closed by a core 65 formed from an annular plate, said bore 65 being placed on and coupled to the end wall of the housing 67. An armature 62 coupled to the core 63, and the plunger integral with the valve body 69, are inserted into the bobbin of the electromagnetic coil 66, and a spring 64 is interposed between the plunger and the armature 62. The electromotive force of the generator 13 is applied to the electromagnetic coil 66. Preferably, the electromotive force of the generator 13 is applied as an input to an electronic controller 14, and then applied, through a switching circuit, actuated when said voltage exceeds a predetermined value, to the electromagnetic coil 66. A passage 71 is connected to the pressure chamber 85 of the actuator 81 through the pipe 18.

The actuator 81 has a diaphragm 84 sandwiched between cup-like housings 82 and 83 to form a pressure chamber 85 and an atmospheric chamber 86. Pad plates 87 and 88 are placed on both surfaces of the diaphragm 84, the plates being connected by the base end of a rod 92. The rod 92 slidably inserted into a hole 91 of the housing 83 is retracted by means of a spring 89 surrounding the rod 92 and interposed between the pad plate 88 and the housing 83. The fore end of the rod 92 is placed into abutment with the aforementioned throttle valve lever 29. The pressure chamber 85 and the atmospheric chamber 86 are provided with orifices 93 and 94 in communication with atmosphere respectively, whereby the extreme operation of the actuator 81 may be restricted.

Figure 3:
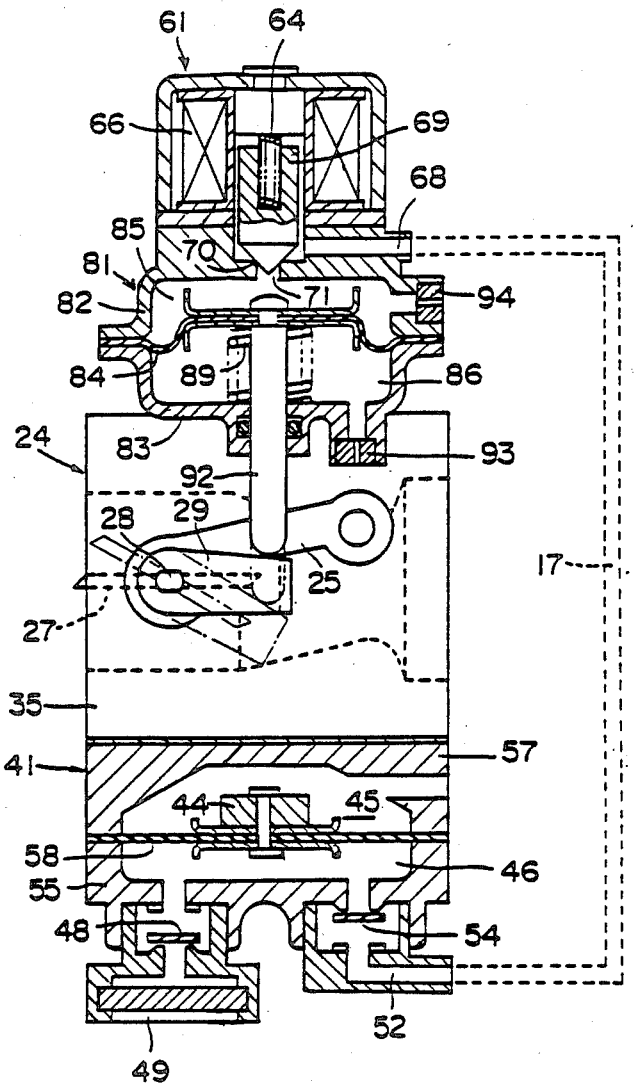
FIGS. 3–6 are side sectional views showing the anti-overrunning device according to the first to fourth embodiments of the present invention.

The above-described vibrating pump 41 is preferably integrally connected to the lower end wall of the body 35 of the carburetor 24, and the control valve 61 and the actuator 81 are connected to the upper end wall of the body 35, as shown in FIG. 3. In this case the housing of the control valve 61 is integrally formed with the housing 82 of the actuator 81. The vibrating pump 41 and the control valve 61 are connected by the pipe 17. However, the vibrating pump 41 and the control valve 61 may be mounted suitably on the engine 10.

In the following, the operation of the anti-overrunning device for the internal combustion engine according to the present invention will be described. In the state where the engine is operating at less than a predetermined number of revolutions, the electromotive force of the generator 13 driven by the crank shaft 15 of the engine 10 is low, and thus the force which the electromotive force of the electromagnetic coil 66 exerts on the valve body 69 is weak and the valve body 69 is urged against the valve seat 70 by the force of the spring 64.

Upon receipt of the vibration of the engine, the vibration pump 41 vibrates up and down by the weight 44 supported on the diaphragm 58. When the diaphragm 58 is inflated upwardly, pressure of the pressure chamber 46 lowers, and therefore the check valve 48 opens to take air into the pressure chamber 46 from the atmospheric opening 49. Subsequently, when the diaphragm 58 is inflated downwardly, the air of the pressure chamber 46 causes the check valve 54 to open and air pressure is discharged toward the pipe 17. However, since the passage 68 remains closed, when the pressure in the pressure chamber 46 is relatively higher, the vibration of the diaphragm 58 is inhibited.

When the engine starts to run over the predetermined number of revolutions, that is, takes the mode of overrunning, the electromotive force applied from the generator 13 to the electromagnetic coil 66 of the control valve 61 increases, and the electromotive force of the electromagnetic coil 66 exerted on the valve body 69 becomes greater than the force of the spring 64 whereby the valve body 69 is moved away from the valve seat 70 to provide communication between the passage 68 and the passage 71 of the pressure chamber 85. The diaphragm 58 of the vibrating pump 41 is increasingly vibrated by the weight 44, the air pressure in the pressure chamber 46 is supplied to the pressure chamber 85 of the actuator 81 through the control valve 61, and the rod 92 is forced down against the force of the spring 89. Thus, the throttle valve lever 29 is rotated clockwise along with the valve shaft 28, as shown by the chain lines in FIG. 3, and the throttle valve 27 is moved to reduce the throttle opening. The flow rate of the fuel mixture taken into the engine is reduced, and the number of revolutions of the engine decreases.

When the number of revolutions of the engine decreases, the voltage of the generator lowers and the electromagnetic force of the electromagnetic coil 66 is weak, and the portion between the passage 68 and 71 or the pressure chamber 85 is again closed by the valve body 69. Then, the air in the pressure chamber 85 of the actuator 81 gradually flows outward through the orifice 94, and the rod 92 is raised upward by the force of the spring 89. The throttle valve lever 29 is rotated counterclockwise by the force of the spring 36, and the engaging portion 37 impinges upon the edge of the lever 25. In this manner, the throttle controlled by opening the throttle valve 27 increases, and again the number of revolutions of the engine increases.

The opening of the throttle valve 27 is generally determined by the rotated position of the lever 25 operated by the trigger wire 30. When the number of revolutions of the engine again increases and exceeds a predetermined number of revolutions, the control valve 61 again opens, and the throttle valve opening is decreased by the actuator 81. The operation as described above is repeated whereby the engine is maintained at less than a predetermined number of revolutions, and the overrunning of the engine is automatically prevented without the operator's operation of the trigger wire 30 according to the variation of load.

Figure 4:
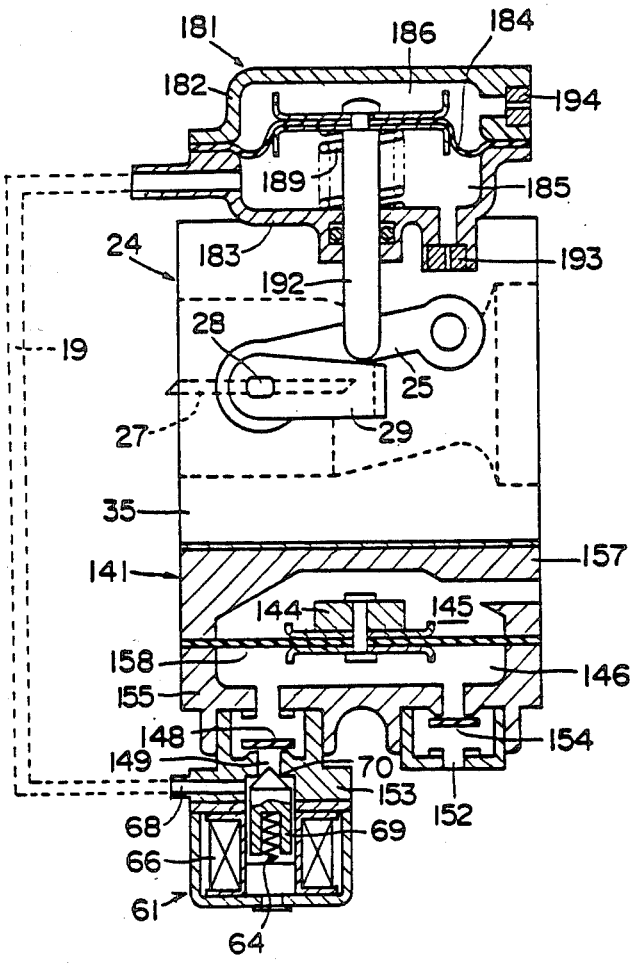

In the embodiment shown in FIG. 4, the actuator 181 is actuated via the control valve 61 by negative pressure generated by the vibrating pump 141. The housing 67 of the control valve 61 is integral with the port member 153 of the vibrating pump 141, and the valve seat 70 is disposed between the passage 68 and the passage 149. The pressure chamber 185 of the actuator 181 is communicated with the passage 68 of the control valve 61 through the pipe 19. The other structures are similar to those of the embodiment shown in FIG. 1, and similar members for the actuator and vibrating pump are indicated by reference numerals to which 100 is added. In this embodiment, when the engine exceeds the predetermined number of revolutions, the valve body 69 of the control valve 61 is moved away from the valve seat 70. Accordingly, air in the pressure chamber 185 of the actuator 181 is taken into the pressure chamber 146 of the vibrating pump 141 through the pipe 19, the passage 68, valve seat 70, passage 149 and check valve 148 and thence discharged from the passage 152 through the check valve 154 to the outside. In this manner, the pressure chamber 185 is negative in pressure, the rod 192 is urged down against the force of the spring 189, the throttle valve 27 along with the throttle valve lever 29 is rotated in the direction of closing the valve.

Figure 5:
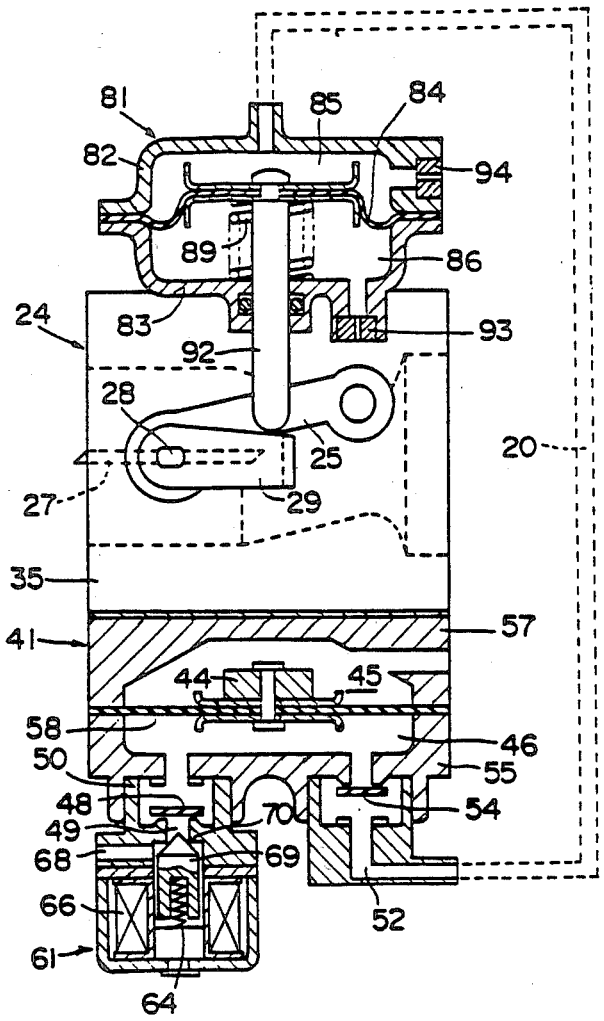
Figure 6:
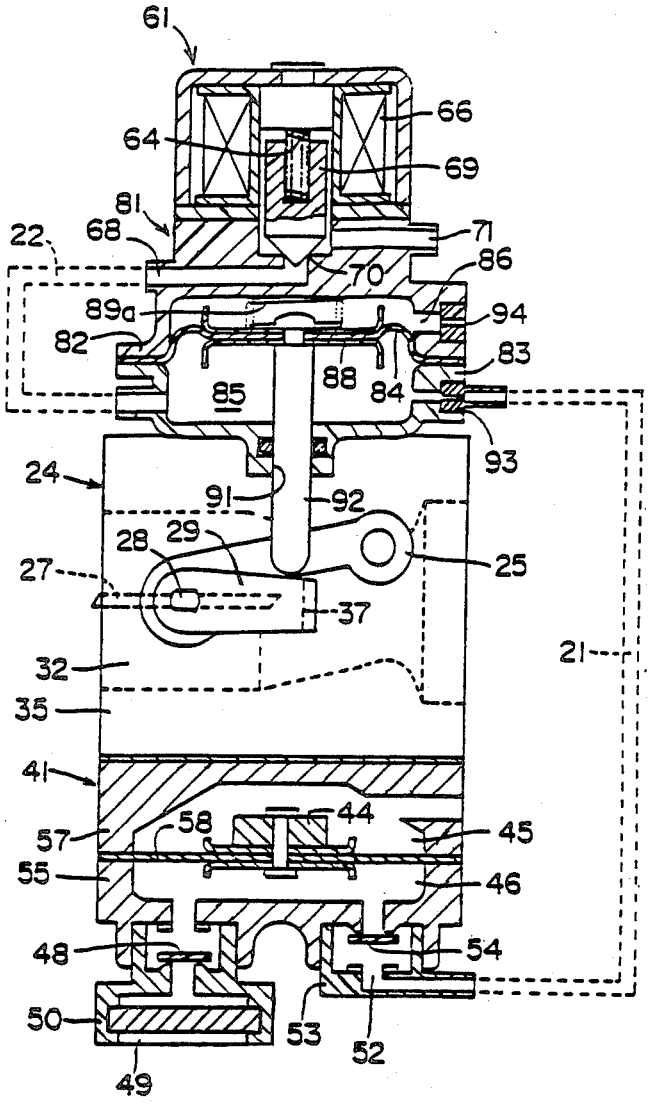

While in the above-described embodiments, the control valve is provided between the vibrating pump and the actuator, it is to be noted that as shown in FIG. 5, a control valve may be connected to an inlet port of a vibrating pump so as to actuate the vibrating pump only during overrunning of the engine, and that as shown in FIG. 6, a control valve may be connected to a pressure chamber of an actuator so as to normally actuate the actuator in the reverse direction and to actuate it in the normal direction by the force of the spring during the overrunning of the engine.

In the embodiment shown in FIG. 5, the control valve 61 is connected to the inlet side of the vibrating pump 41, namely, to the side of the check valve 48. The housing of the control valve 61 is integrally formed with a port member 50. An outlet port of the vibrating pump 41, that is, the side of the check valve 54 is connected to a pressure chamber 85 of an actuator 81 by means of a pipe 20. The structures of the vibrating pump 41, actuator 81 and control valve 61 are similar to those in the embodiment shown in FIG. 3. Similar members are indicated by the reference numerals previously used and further description thereof will be omitted.

In this embodiment, in the normal running of the engine, since the inlet port of the vibrating pump 41, that is, the atmospheric opening 49 is closed by the control valve 61, the actuation of the diaphragm 58 is restrained even though subjected to the vibration of the engine, and the rod 92 of the actuator 81 is forced upward by the force of the spring 89. When the engine takes the mode of overrunning, the electromotive force of the electromagnetic coil 66 of the control valve 61 exerting on the valve body 69 becomes greater than the force of the spring 64, and the valve body 69 is moved away from the valve seat 70 whereby the passage 68, in communication with the atmosphere, comes into communication with the pressure chamber 46 of the vibrating pump 41 to release the cancelled state of the vibrating pump 41. Accordingly, the diaphragm 58 of the vibrating pump 41, subjected to the vibration of the engine, is reciprocated to supply air under pressure from the pressure chamber 46 to the pressure chamber 85 of the actuator 81 through the pipe 20, the rod 92 is forced down against the force of the spring 89, and the throttle valve 27 is rotated along with the throttle valve lever 29 in the direction of closing of the valve.

In the embodiment shown in FIG. 6, the vibrating pump 41 is connected to the actuator 81 through a pipe 21. The control valve 61 is integrally formed with the housing of the actuator 81, the passage 68 is communicated with the pressure chamber 85 of the actuator 81 through the pipe 22, and the passage 71 is opened to the atmosphere. The actuator 81 causes the rod 92 to be forced downward by the virtue of the force of the spring 89a located in the atmospheric chamber 86. The other structures are similar to those shown in FIG. 3, and similar members are indicated by the reference numerals previously used, and further description thereof will be omitted.

In this embodiment, in the normal running of the engine, air pressure from the vibrating pump 41 is supplied to the pressure chamber 85 of the actuator 81, and the rod 92 is forced upwardly against the force of the spring 89a. When the engine starts to overrun, the force which the electromagnetic coil 66 of the control valve 61 exerts on the valve body 69 becomes greater than the force of the spring 64, and the valve body 69 is moved away from the valve seat 70. Accordingly, the air pressure of the pressure chamber 85 is released into the atmosphere via the pipe 22, passage 68, valve seat 70 and passage 71, the rod 92 is forced downward by the force of the spring 89*a*, and the throttle valve 27 is rotated along with the throttle valve lever 29 in the closing direction.

As described above, the present invention comprises a vibrating pump for generating pneumatic pressure by vibrations of the engine; an actuator for actuating a throttle valve of a carburetor in a direction of closing the valve; and a control valve for controlling a flow of the pneumatic pressure from said vibrating pump to actuator during overrunning of the engine. In this case, the control valve is actuated by virtue of the electromotive force of a generator driven by the engine.

The relationship between the voltage of the generator driven by the engine to actuate the electromagnetic valve and the number of revolutions of the engine is very stable. Thus, the control valve operation is steadier, more positive in operation, and reliability thereof is enhanced.

According to the present invention, the opening degree of the throttle valve of the carburetor is automatically reduced when the engine is overrun to reduce the flow rate of a mixture taken into the engine. Therefore, there is provided a new anti-overrunning device which is positive in operation, may be run at a substantially reasonable fuel cost (rate of fuel consumption) in all running levels of the engine, is free of spark plug fouling, results in less exhaust fume, and there is less tar accumulation in the muffler.

Furthermore, since the operator can perform his work while a throttle handle is left fully opened because of actuation of the anti-overrunning device, the working may be more efficient, and the damage to, and the shortening of life of, the engine may be avoided.

We claim:

1. An anti-overrunning device for an internal combustion engine comprising a vibrating pump for generating pneumatic pressure by vibrations of the engine, an actuator for actuating a throttle valve of a carburetor in a direction of closing the valve, and a control valve for controlling a flow of the pneumatic pressure from said vibrating pump to said actuator during overrunning of the engine, and said control valve being actuated by virtue of the electromotive force of a generator driven by the engine.

* * * * *